US008543045B2

(12) United States Patent
Arikawa et al.

(10) Patent No.: US 8,543,045 B2
(45) Date of Patent: Sep. 24, 2013

(54) FIXING DEVICE AND IMAGE FORMING APPARATUS

(75) Inventors: Kiichirou Arikawa, Kanagawa (JP); Shigeru Watanabe, Kanagawa (JP); Yasutaka Gotoh, Kanagawa (JP); Hiroko Furukata, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 314 days.

(21) Appl. No.: 12/961,247

(22) Filed: Dec. 6, 2010

(65) Prior Publication Data

US 2011/0318073 A1 Dec. 29, 2011

(30) Foreign Application Priority Data

Jun. 25, 2010 (JP) ..... 2010-145111

(51) Int. Cl.
*G03G 15/20* (2006.01)

(52) U.S. Cl.
USPC ..... 399/328

(58) Field of Classification Search
USPC ..... 399/328
See application file for complete search history.

(56) References Cited

U.S. PATENT DOCUMENTS

2004/0234290 A1* 11/2004 Tomatsu ..... 399/67
2005/0191071 A1* 9/2005 Katayanagi et al. ..... 399/45
2008/0205924 A1* 8/2008 Fujimoto ..... 399/70
2009/0052925 A1* 2/2009 Fujimoto ..... 399/67
2009/0226227 A1 9/2009 Furukata et al.

FOREIGN PATENT DOCUMENTS

JP 2008-233133 A 10/2008

* cited by examiner

*Primary Examiner* — Walter L Lindsay, Jr.
*Assistant Examiner* — Barnabas Fekete
(74) *Attorney, Agent, or Firm* — Sughrue Mion, PLLC

(57) ABSTRACT

A fixing device includes a rotatable fixing roller, an endless fixing belt, a pressing unit having first and second pressing members that press a surface of the fixing belt against the fixing roller, a fixed support member that supports the fixing roller rotatably, a movable support member that supports the first pressing member in a fixed state and supports the second pressing member such as to be movable closer to and away from the fixing roller, a first pressure spring that presses the movable support member closer to the fixing roller, a second pressure spring that presses the second pressing member closer to the fixing roller, and a switch mechanism that switches between a first state in which the first and second pressing members are pressed against the fixing roller and a second state in which only the second pressing member is pressed against the fixing roller.

9 Claims, 16 Drawing Sheets

FIXING DEVICE AND IMAGE FORMING APPARATUS

CROSS REFERENCE TO RELATED APPLICATIONS

This application is based on and claims priority under 35 USC 119 from Japanese Patent Application No. 2010-145111 filed Jun. 25, 2010.

BACKGROUND (i) Technical Field

The present invention relates to a fixing device and an image forming apparatus.

(ii) Related Art

In image forming apparatuses, such as a printer and a copying machine, which form an image formed by developer onto a recording medium such as paper, a fixing device fixes an unfixed image on the recording medium. There are known fixing devices including a rotatable fixing roller, an endless fixing belt that rotates in contact with the fixing roller, and a pressing member that contacts the fixing belt from the back side and presses a surface of the fixing belt against the fixing roller so as to form a fixing portion (pressing portion) through which a fixing object passes.

SUMMARY

According to an aspect of the invention, there is provided a fixing device including a rotatable fixing roller; an endless fixing belt that rotates in contact with the fixing roller; a pressing unit having a first pressing member and a second pressing member, the first pressing member contacting the fixing belt from a back side of the fixing belt and pressing a surface of the fixing belt against the fixing roller to form a fixing portion through which a fixing object passes, the second pressing member contacting the fixing belt from the back side of the fixing belt and pressing the surface of the fixing belt against the fixing roller to form the fixing portion through which the fixing object passes; a fixed support member that supports the fixing roller rotatably; a movable support member that rocks closer to and away from the fixing roller, supports the first pressing member in a fixed state, and supports the second pressing member adjacent to the first pressing member in a manner such that the second pressing member is movable closer to and away from the fixing roller; a first pressure spring that applies pressure to move the movable support member closer to the fixing roller; a second pressure spring that applies pressure to move the second pressing member closer to the fixing roller; and a switch mechanism that changes a movable range of the movable support member so as to switch between a first state in which the first pressing member and the second pressing member are pressed against the fixing roller with the fixing belt being disposed therebetween and a second state in which only the second pressing member is pressed against the fixing roller with the fixing belt being disposed therebetween.

BRIEF DESCRIPTION OF THE DRAWINGS

Exemplary embodiments of the present invention will be described in detail based on the following figures, wherein.

DETAILED DESCRIPTION

Embodiments for carrying out the present invention (hereinafter simply referred to as exemplary embodiments) will be described below with reference to the attached drawings.

First Exemplary Embodiment

Figure 1:
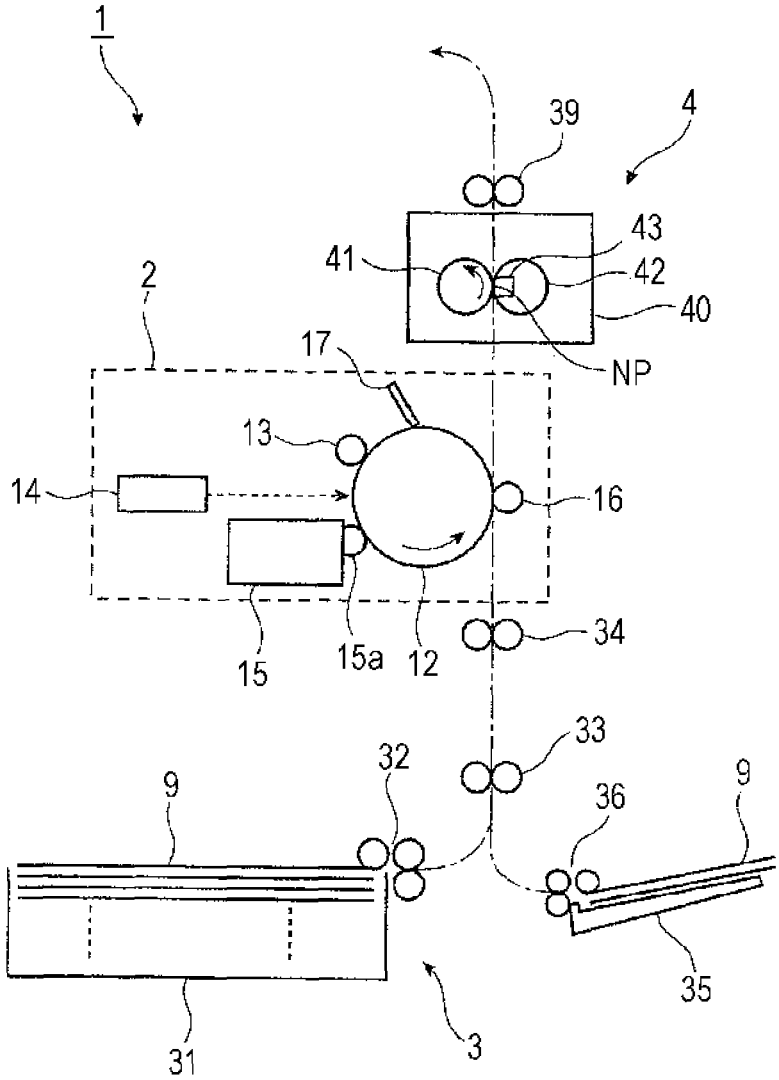
FIG. 1 is a schematic view illustrating an image forming apparatus including a fixing device according to a first exemplary embodiment.

FIG. 1 illustrates an image forming apparatus 1 (and a fixing device 4) according to a first exemplary embodiment of the present invention.

The image forming apparatus 1 includes, in a housing (not shown), an imaging device 2 that forms an unfixed toner image based on image information and finally transfers the toner image onto a recording medium 9 such as paper, a paper feed device 3 that stores the recording medium 9 and transports and supplies the recording medium 9 to the imaging device 2, and a fixing device 4 that fixes the toner image, which is transferred in the imaging device 2, on the recording medium 9. In FIG. 1, a one-dot chain line with an arrow indicates a transport path for the recording medium 9.

The imaging device 2 can form and transfer a toner image, for example, by a known electrophotographic method. More specifically, the imaging device 2 includes a photoconductor drum 12 that rotates in a direction of the arrow. Around the photoconductor drum 12, a charging device 13, an exposure device 14, a developing device 15, a transfer device 16, and a cleaning device 17 are arranged. The charging device 13 charges a surface (image carrying surface) of the photoconductor drum 12. The exposure device 14 irradiates the charged surface of the photoconductor drum 12 with light based on image information (signal) so as to form an electrostatic latent image having different potentials. The developing device 15 develops the electrostatic latent image on the photoconductor drum 12 with toner serving as developer so as to form a toner image. The transfer device 16 transfers the toner image onto a recording medium 9 supplied from the paper feed device 3. The cleaning device 17 cleans the surface of the photoconductor drum 12 by removing toner remaining on the surface after transfer.

For example, the photoconductor drum 12 includes a cylindrical base and an image carrying surface having a photoconductive layer (photosensitive layer) made of an organic photosensitive material. The charging device 13 is of a contact charging type that charges the surface of the photoconductor drum 12 by applying a predetermined charging voltage to a charging roller rotating in contact with the surface of the photoconductor drum 12. The exposure device 14 is formed by, for example, a light emitting diode (LED) recording head or a semiconductor laser scanning device. The exposure device 14 receives image signals obtained by subjecting, to required processing, image information, which is input from an image reading device or a storage-medium reading device provided in or connected (in a wired or wireless manner) to the image forming apparatus 1 and an external apparatus serving as a device for forming an image, such as a computer, by an image processing device (not shown).

The developing device 15 supplies charged developer containing toner of a predetermined color (e.g., one-component developer or two-component developer) onto the surface of the photoconductor drum 12 via a developing roller 15*a* to which a developing voltage is applied. The transfer device 16 is of a contact type that performs transfer by applying a predetermined transfer voltage to a transfer roller rotating in contact with the surface of the photoconductor drum 12.

The paper feed device 3 includes a storage cassette 31 that stores stacked plural recording media 9 of a predetermined size to be supplied to the imaging device 2, and a supply unit 32 that supplies and transports the recording media 9 stored in the storage cassette 31 one by one. As required, plural storage cassettes 31 are provided. Further, the paper feed device 3 is connected to a sheet transport path for sheet feeding through which the recording media 9 are transported from the storage cassette 31 to a transfer portion in the imaging device 2 (between the photoconductor drum 12 and the transfer device 16). The sheet transport path includes plural pairs of transport rollers 33 and 34, a transport guide member, etc. The pair of sheet transport rollers 34 serve as a pair of transport-timing adjusting rollers that temporarily stop a leading edge of a transported recording medium 9 and are then driven to feed the recording medium 9 at a predetermined paper feed time. The sheet transport path is also provided between the imaging device 2 and the fixing device 4.

In a housing 40 of the fixing device 4, a heating roller 41, an endless fixing belt 42, and a pressing unit 43 are arranged. The heating roller 41 is heated by a heating unit so that the surface temperature of the heating roller 41 is kept at a predetermined temperature, and rotates in a direction of the arrow. The endless fixing belt 42 rotates in contact with a portion of the surface of the heating roller 41 extending substantially in a rotation axis direction A. The pressing unit 43 contacts the fixing belt 42 from a back surface side, and presses a front surface of the fixing belt 42 against the heating roller 41 so as to form a pressing portion (fixing portion) NP through which a fixing object (a recording medium 9 on which a toner image is transferred). Referring to FIG. 1, a pair of output rollers 39 output the recording medium 9 after fixing. Details of the fixing device 4 will be described below.

The image forming apparatus 1 performs image formation as follows.

In the imaging device 2, first, the photoconductor drum 12 starts rotation, and the surface of the rotating photoconductor drum 12 is charged with a predetermined charging potential by the charging device 13. After that, light based on an image signal is applied onto the charged surface of the photoconductor drum 12 by the exposure device 14, whereby an electrostatic latent image having a predetermined latent image potential is formed. Subsequently, when the electrostatic latent image moves with the rotation of the photoconductor drum 12 and passes through the developing device 15, the toner supplied from the developing roller 15*a* of the developing device 15 electrostatically adheres to the latent image to form a developed toner image. After that, the toner image on the photoconductor drum 12 is electrostatically transferred onto a recording medium 9 supplied and transported from the paper feed device 3 at a transfer position opposing the transfer device 16. After the toner image is transferred, the surface of the photoconductor drum 12 is cleaned by the cleaning device 17.

Next, the recording medium 9 on which the unfixed toner image has been formed in the imaging device 2 is transported to the fixing device 4, and is led into the pressing portion NP between the heating roller 41 and the fixing belt 42. In the fixing device 4, the recording medium 9 passes through the pressing portion NP while being nipped in the pressing portion NP, so that the unfixed toner image is heated under pressure to be fixed on the recording medium 9. After fixing, the recording medium 9 is output from the fixing device 4, and is transported by the pair of output rollers 39 into an output storage portion (not shown). Thus, a toner image is formed on one side of the recording medium 9.

The image forming apparatus 1 can use, as a recording medium 9 serving as an object on which an image is formed, not only sheets, such as a recording sheet, thick paper, a transparent sheet, and a postcard, but also envelope-like media shaped like a bag, such as an envelope. An envelope-like recording medium 9 is stored in the storage cassette 31 of the paper feed device 3 and is transported to the transfer position in the imaging device 2 through the sheet transport path for sheet feeding during image formation. Alternatively, the envelope-like recording medium 9 is stored in a manual feeding table 35, and is joined into the sheet transport path for sheet feeding by a supply unit 36 and transported to the transfer position in the imaging device 2 during image formation, as illustrated in FIG. 1.

Next, the fixing device 4 will be described in detail.

Figure 2:
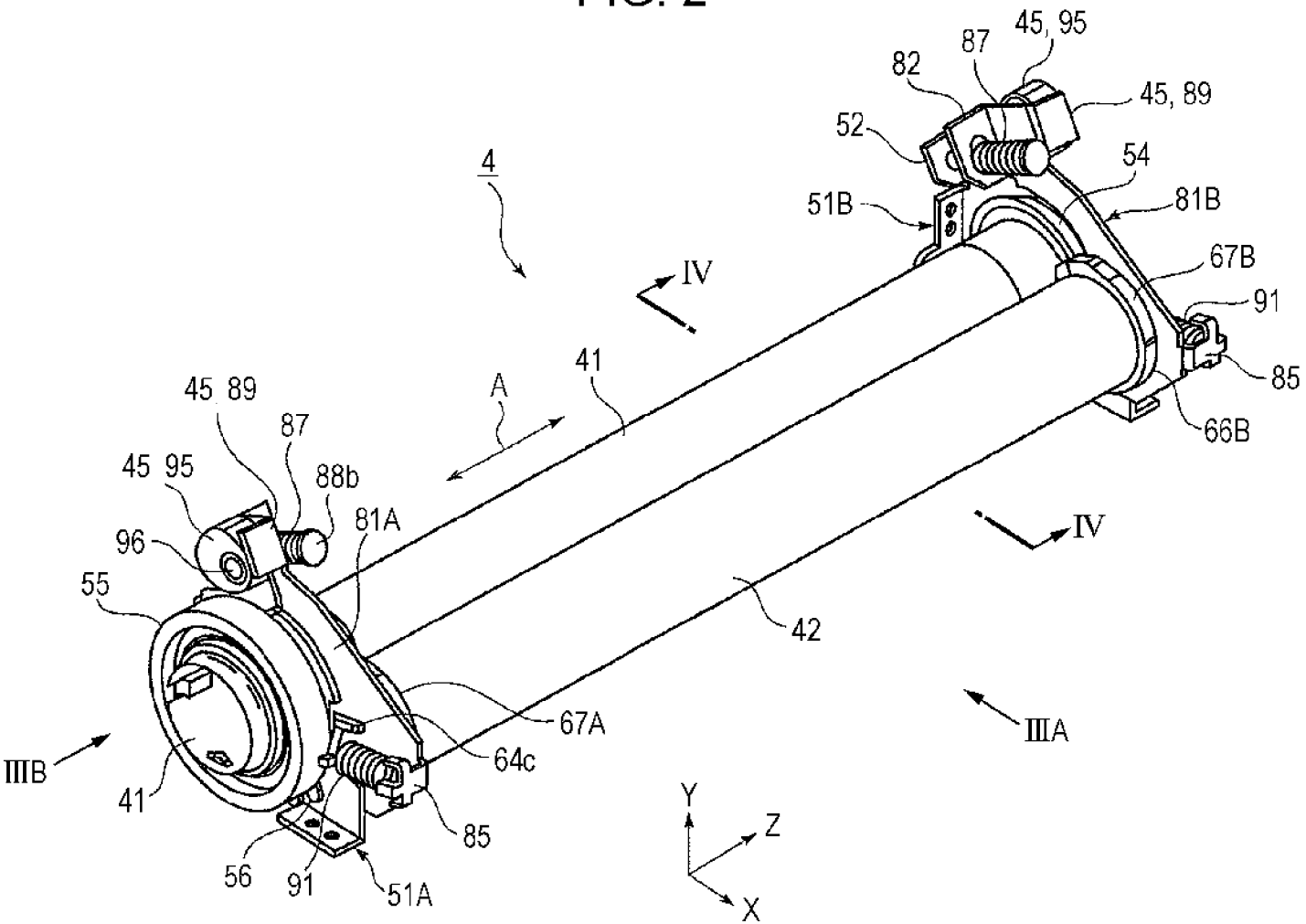
FIG. 2 is a perspective view of the principal part of the fixing device used in the image forming apparatus illustrated in FIG. 1.
Figure 3A:
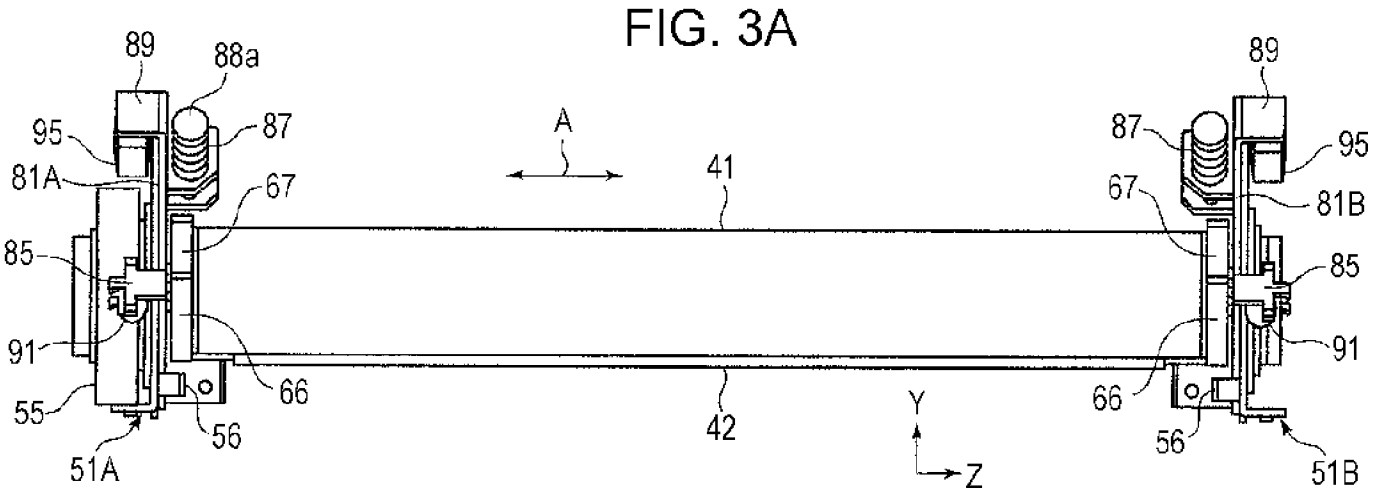
FIG. 3A is a front view of the fixing device on arrow IIIA in FIG. 2.
Figure 3C:
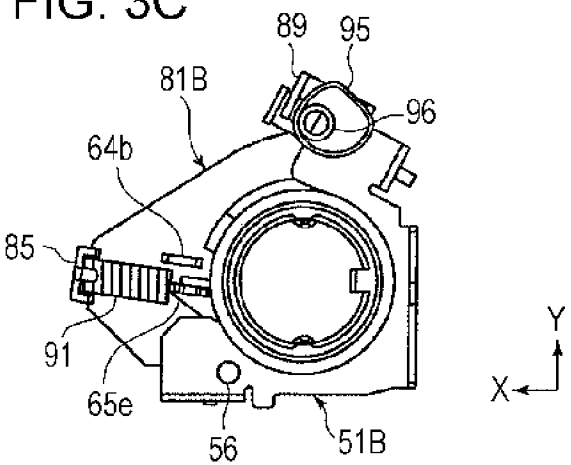
FIG. 3C is a side view, as viewed in a direction opposite the direction of arrow IIIB in FIG. 2.
Figure 3B:
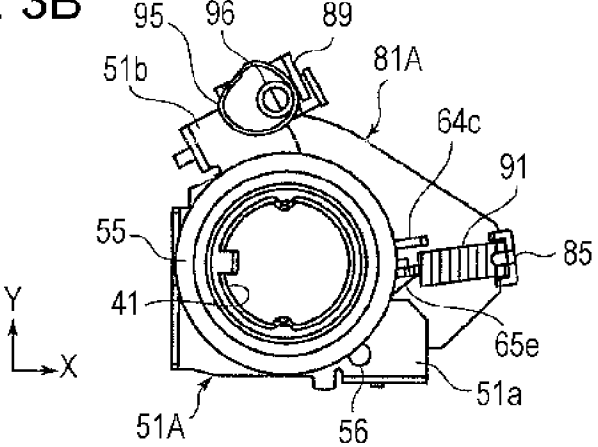
FIG. 3B is a side view of the fixing device on arrow IIIB in FIG. 2.
Figure 4:
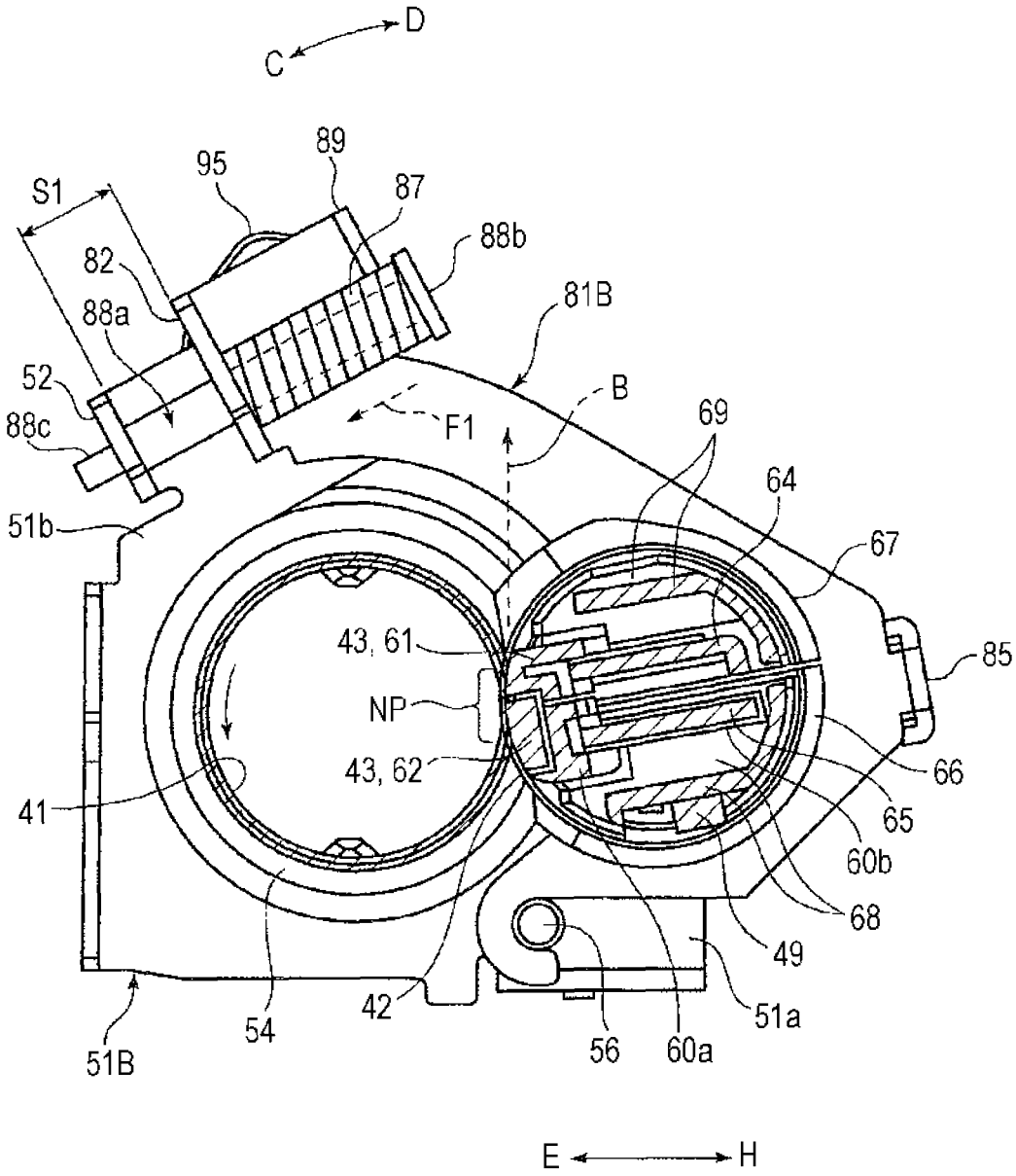
FIG. 4 is a partial cross-sectional view of the fixing device, taken along line IV-IV in FIG. 2 (in a normal mode)

As illustrated in FIGS. 2 to 4, the fixing device 4 includes fixed frames 51 (51A and 51B), pressing rocking frames 81, first pressure springs 87, second pressure springs 91, and switch mechanisms 45 in addition to the heating roller 41, the fixing belt 42, and the pressing unit 43 described above. The fixed frames 51 support the heating roller 41 rotatably. The pressing rocking frames 81 are turnably attached to ends of the fixed frames 51 with shafts 56 being disposed therebetween, rock closer to and away from the heating roller 41, and support the pressing unit 43 in a required state. The first pressure springs 87 apply a pressure such as to move the pressing rocking frames 81 closer to the heating roller 41. The second pressure springs 91 apply a pressure such as to move one structure that forms the pressing unit 43 closer to the heating roller 41. The switch mechanisms 45 switch the pressing unit 43 to a required state by changing the rocking range of the pressing rocking frames 81.

In the fixing device 4, the switch mechanisms 45 change the rocking range of the pressing rocking frames 81 so as to switch a pressing state in which the pressing unit 43 is pressed against the heating roller 41 with the fixing belt 42 being disposed therebetween. That is, the switch mechanisms 45 switch between a first state (referred to as a normal mode) and a second state (referred to as an envelope mode). The first state is suitable for image formation (including a fixing step) using a sheet (different from an envelope-like medium) as a recording medium 9 (see FIGS. 3 and 4). The second state is suitable for image formation using an envelope-like medium as a recording medium 9 (see FIGS. 12 and 14).

The heating roller 41 includes a metal cylindrical base having a length larger than the maximum transport width of the recording medium 9 serving as a fixing object, and an elastic layer and a release layer formed on a surface of the cylindrical base in this order. A heating unit (not shown) for heating the heating roller 41 to a required temperature is provided in the cylindrical base of the heating roller 41. The heating roller 41 is rotatably supported at both ends by the fixed frames 51A and 51B.

The heating roller 41 is attached at both ends to the fixed frames 51A and 51B, respectively, with bearings 54 being disposed therebetween, and is rotated at a required speed by transmitting rotational power from a rotating device (not shown) provided in a body of the image forming apparatus 1 to a gear 55 fixed to one end of the heating roller 41. The surface temperature of the heating roller 41 is detected by a temperature detector (not shown), and a heating operation of the above-described heating unit is controlled on the basis of information about the detection so that the surface temperature of the heating roller 41 is kept at a required temperature.

Each of the fixed frames 51 includes a curved portion for holding the heating roller 41, and two end portions 51*a* and 51*b* projecting on both sides between which the heating roller 41 is provided. The end portion 51*a* of the fixed frame 51 is located on an upstream side of the pressing portion NP in a passage direction B of the fixing object, and the shaft 56 to which a part of the pressing rocking frame 81 is attached is provided in the end portion 51*a*. The end portion 51*b* of the fixed frame 51 is located on a downstream side of the pressing portion NP in the passage direction B of the fixing object, and a spring support face portion 52 for supporting the corresponding first pressure spring 87 is provided in the end portion 51*b*. The spring support face portion 52 is bent toward the inner side of the fixed frame 51. Both of the fixed frames 51 are fixed to the housing 40 of the fixing device 4.

The fixing belt 42 is a cylindrical belt having a width substantially equal to the length (axial dimension) of the heating roller 41. The fixing belt 42 is formed by coating a surface of a thin cylindrical belt base formed of synthetic resin, such as polyimide, with a release layer formed of fluorine resin or the like.

As illustrated in FIG. 4, the pressing unit 43 includes a long rigid member (first pressing member) 61 and an elastic member (second pressing member) 62 that have a length substantially equal to the width of the fixing belt 42. In the pressing unit 43 of the first exemplary embodiment, the rigid member 61 is located on a downstream side of the pressing portion NP in the passage direction B of the fixing object, and the elastic member 62 is located on an upstream side of the rigid member 61 in the passage direction B of the fixing object. The rigid member 61 and the elastic member 62 are provided side by side.

Figure 7:
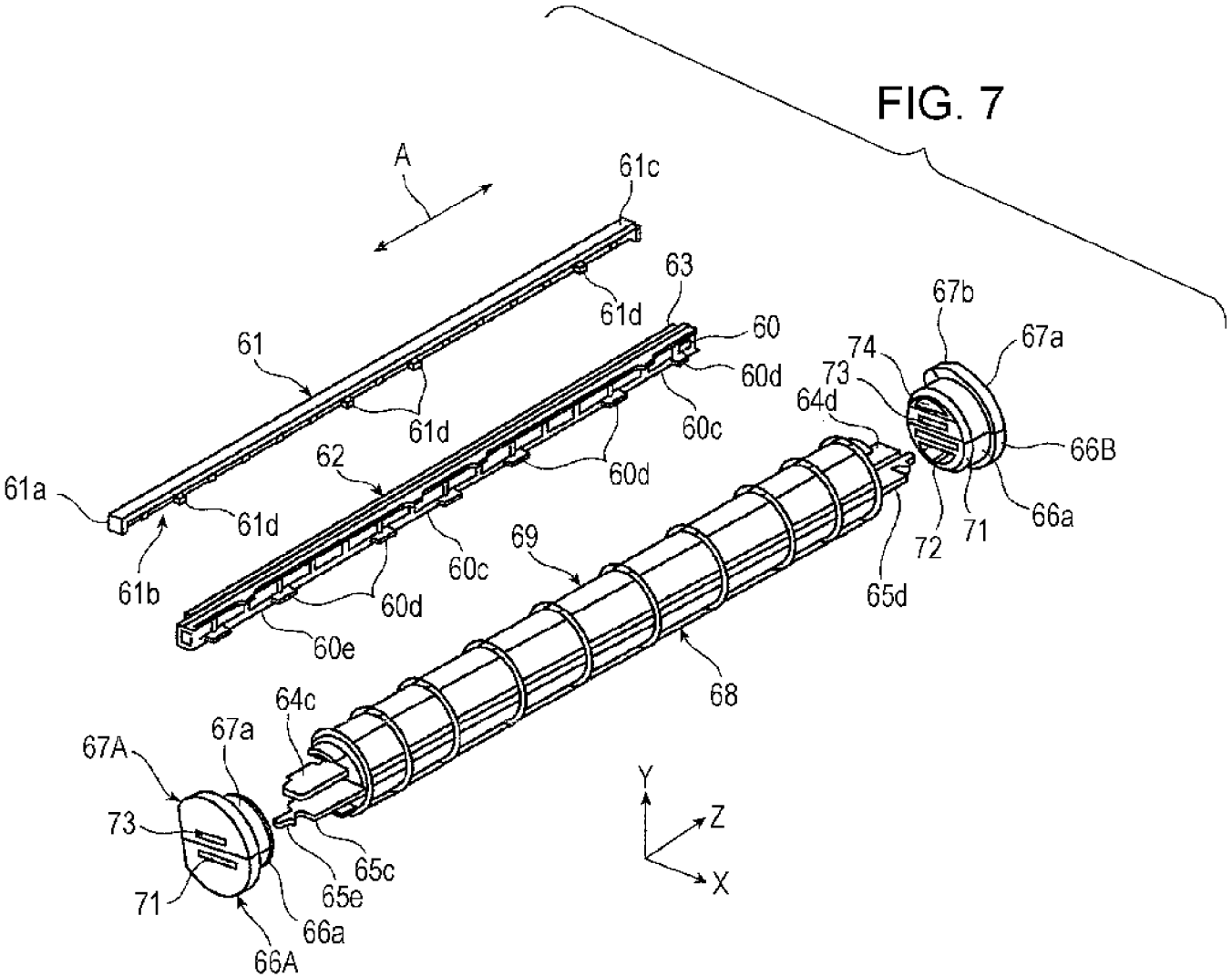
FIG. 7 is an exploded perspective view of the structure illustrated in FIG. 6.

The rigid member 61 is formed by an inelastic member made of synthetic resin, metal, or the like. As illustrated in FIGS. 4 and 7, the rigid member 61 of the first exemplary embodiment includes a contact portion 61*a* that presses the fixing belt 42 against the surface of the heating roller 41, and a fitting portion 61*b* in which an end of a first support plate 64 for supporting the rigid member 61 on the back side of the contact portion 61*a*, which will be described below, is fitted. For example, the fitting portion 61*b* includes a side face portion 61*c* extending from the contact portion 61*a*, and holding projections 61*d* that are provided at a distance, corresponding to the thickness of the first support plate 64, from the side face portion 61*c* and are dotted in the axial direction A.

As illustrated in FIGS. 4 and 7, the elastic member 62 includes an elastic contact element 63 that presses the fixing belt 42 against the surface of the heating roller 41, and a holding element 60 that holds the elastic contact element 63. The elastic contact element 63 is formed of an elastic material such as rubber. In the first exemplary embodiment, the elastic contact element 63 is shaped like a long plate (having a rectangular cross section in a no-load state) formed of silicon rubber. The holding element 60 includes a receiving body portion 60*a* that receives the elastic contact element 63, and a fitting portion 60*b* in which an end of a second support plate 65 for supporting the elastic member 62 (elastic contact element 63), which will be described below, is fitted on the back side of the receiving body portion 60*a*. For example, the fitting portion 60*b* includes holding projections 60*c* and 60*d* that oppose each other in a staggered manner in the axial direction A. The holding projections 60*c* and 60*d* are provided at a distance, corresponding to the thickness of the second support plate 65, from both edges of the back side of the receiving body portion 60*a*.

As illustrated in FIG. 4, the rigid member 61 and the elastic member 62 of the pressing unit 43 are independently supported by two support plates 64 and 65.

Figure 8:
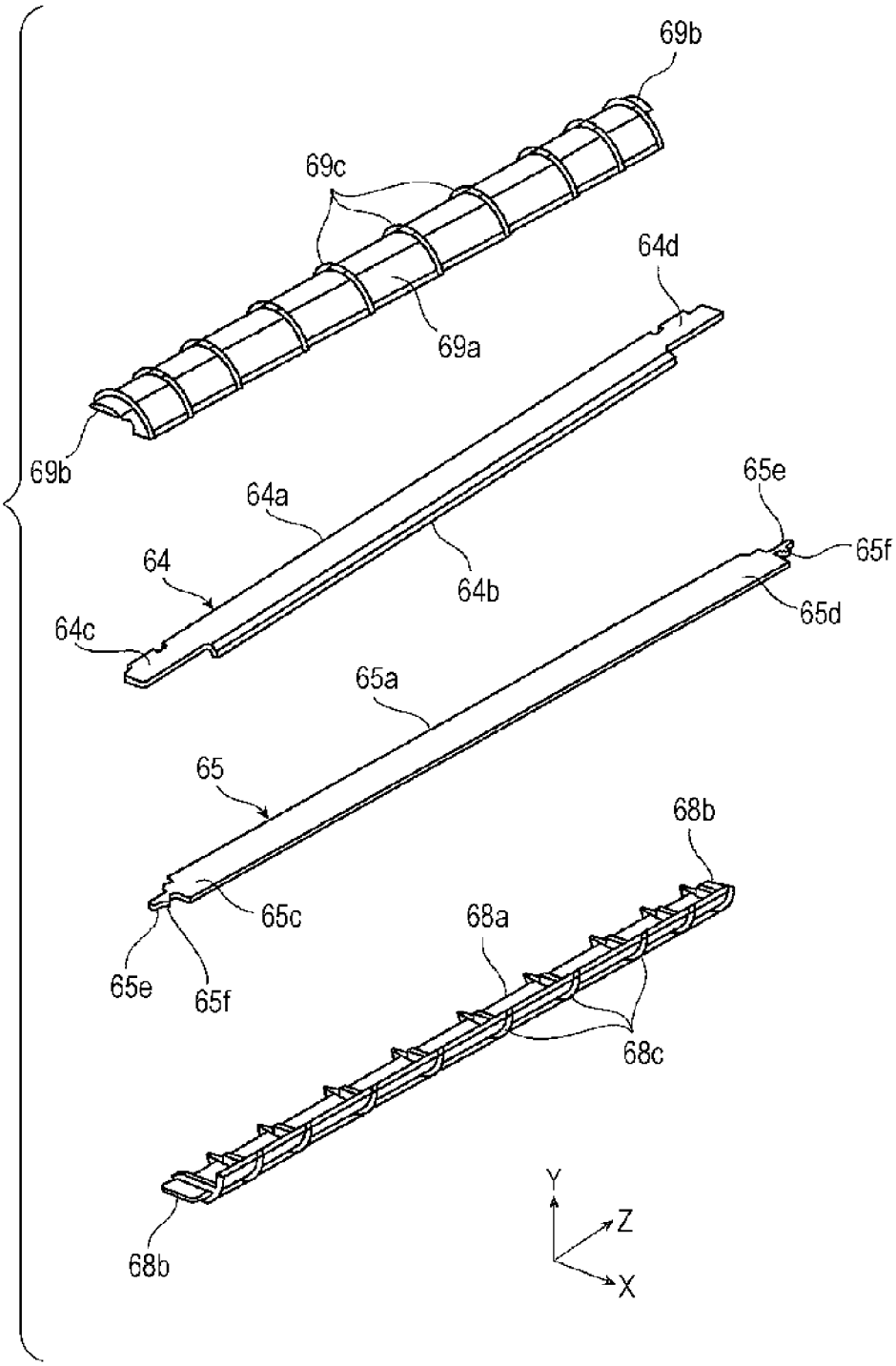
FIG. 8 is an exploded perspective view of a part of the structure of FIG. 6 (two support plates and separate peripheral guide plates)

As illustrated in FIG. 8, the first support plate 64 is formed by a long rectangular metal plate, and supports the rigid member 61 with a body portion 64*a* serving as one end portion extending in the longitudinal direction (also in the axial direction A) being fitted in the fitting portion 61*b* of the rigid member 61. The other end portion 64*b* of the first support plate 64 extending in the longitudinal direction is bent to increase the total mechanical strength of the first support plate 64. As illustrated in FIG. 8, the second support plate 65 is formed by a long rectangular metal plate, and supports the elastic member 62 with a body portion 65*a* serving as one end portion extending in the longitudinal direction being fitted in the fitting portion 60*b* of the holding element 60 in the elastic member 62. Longitudinal end portions 64*c*, 64*d*, 65*c*, and 65*d* of the end portions 64*a* and 65*a* of the two support plates 64 and 65 are attached to attachment holes or attachment cuts of the pressing rocking frames 81, as will be described below.

As illustrated in FIGS. 5 to 9, the fixing belt 42 is supported at both ends by a pair of separate end guide plates 66 and 67, and is supported on an inner peripheral surface by separate peripheral guide plates 68 and 69.

The separate end guide plate 66 and the separate peripheral guide plate 68 serve as an upstream separate end guide plate and an upstream separate peripheral guide plate, respectively, which hold and guide a portion of the fixing belt 42 on an upstream side of almost the boundary between the rigid member 61 and the elastic member 62 of the pressing unit 43 in the passage direction B of the fixing object. The separate end guide plate 67 and the separate peripheral guide plate 69 serve as a downstream separate end guide plate and a downstream separate peripheral guide plate, respectively, which hold and guide a portion of the fixing belt 42 on a downstream side of almost the boundary between the rigid member 61 and the elastic member 62 of the pressing unit 43 in the passage direction B of the fixing object.

Figure 6A:
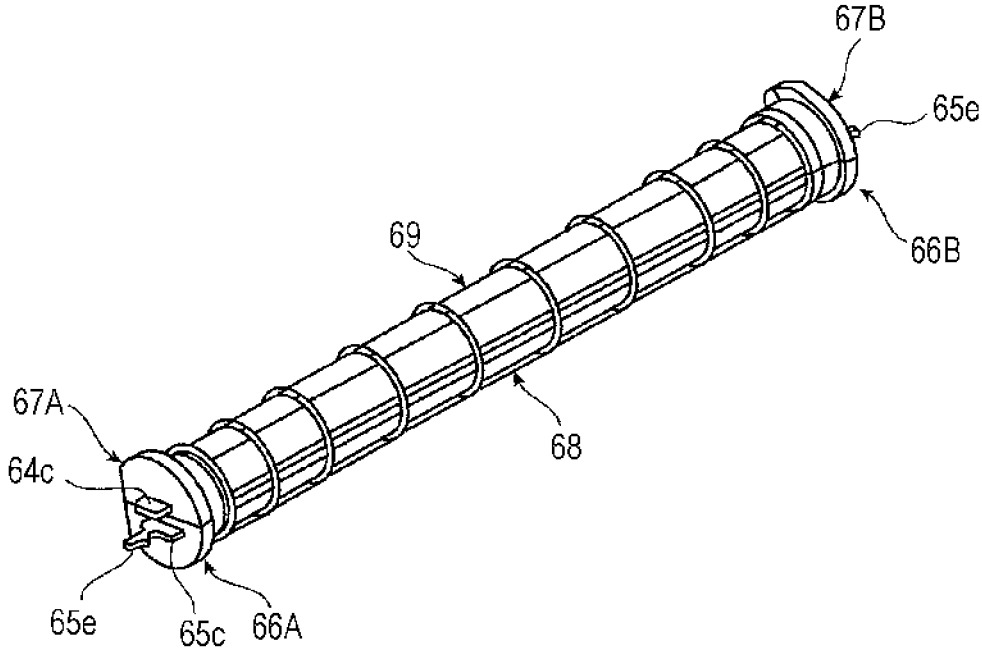
FIGS. 6A and 6B are perspective views illustrating a structure obtained by removing an endless belt from the pressing rotating member in FIG. 5, as viewed in two directions.
Figure 6B:
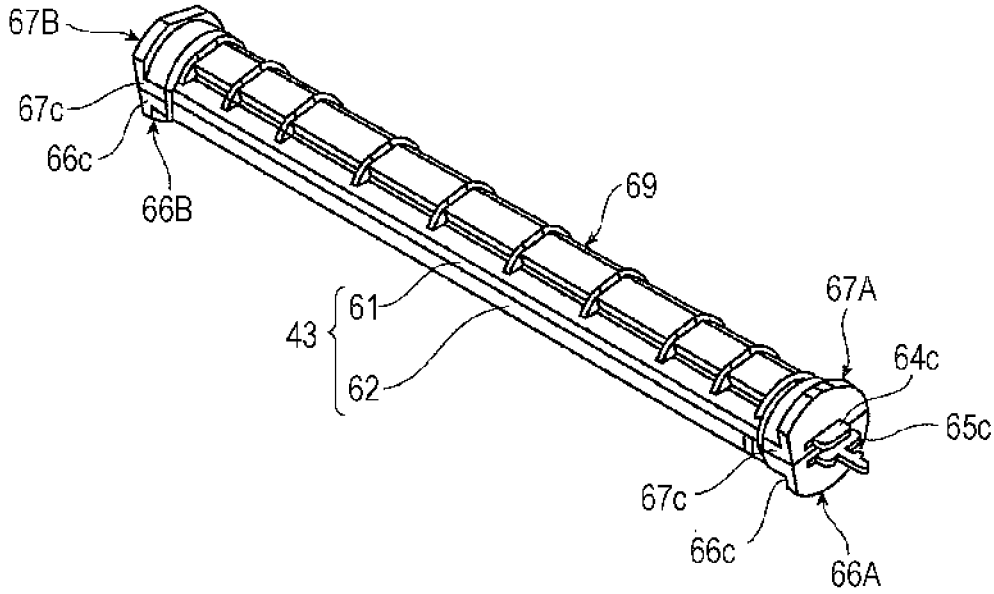
Figure 9A:
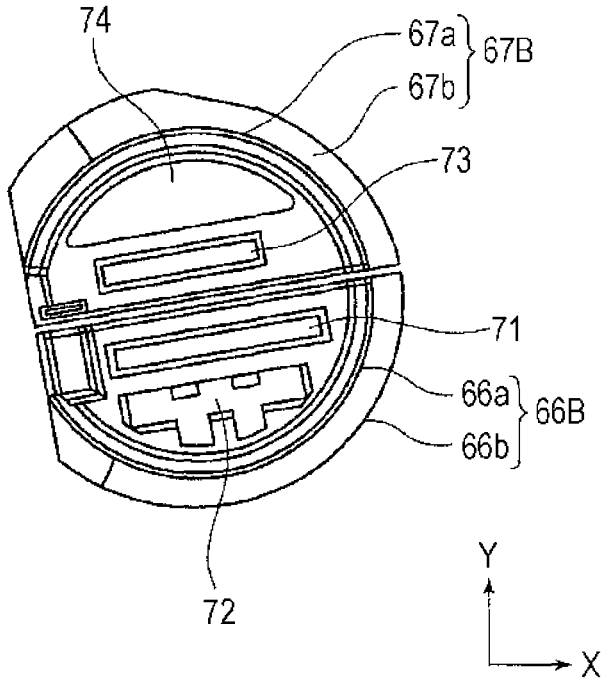
FIGS. 9A and 9B illustrate separate end guide plates in the fixing device in FIG. 4, as viewed from the front and back sides.
Figure 9B:
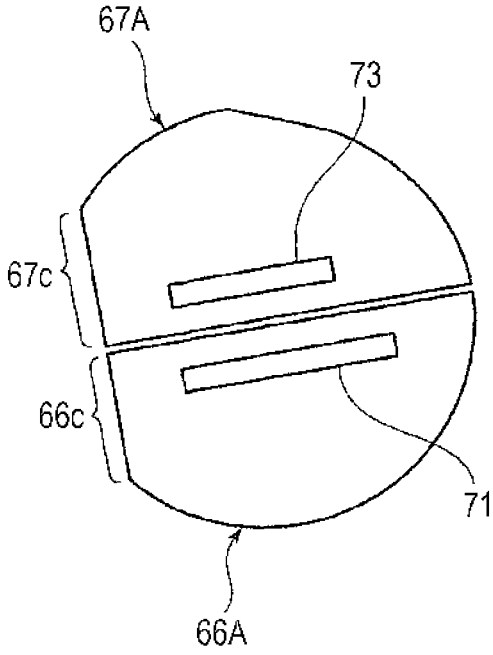

As illustrated in FIGS. 6, 7, and 9, the upstream separate end guide plates 66 and the downstream separate end guide plates 67 include semicircular peripheral-surface guide portions 66*a* and 67*a* having semicylindrical guide faces that hold and guide the ends of the fixing belt 42 from the inner peripheral side, and flange guide portions 66*b* and 67*b* having vertical guide faces that project in a substantially vertical direction at outer ends of the peripheral-surface guide portions 66*a* and 67*a* and that guide the ends of the fixing belt 42 by contact therewith. Portions of the peripheral-surface guide portions 66*a* and 67*a* and the flange guide portions 66*b* and 67*b* of the separate end guide plates 66 and 67 where the rigid member 61 and the elastic member 62 of the pressing unit 43 are provided (hereinafter these portions will be referred to as pressing-portion opposing portions 66*c* and 67*c*) are cut in a linear form (or in a planar form) (FIGS. 6A, 6B, and 9B).

As illustrated in FIGS. 7 and 9, the peripheral-surface guide portions 66*a* of the upstream separate end guide plates 66 have rectangular fitting holes 71 in which end portions 65*c* and 65*d* of the body portion 65*a* of the second support plate 65 are fixedly fitted, and substantially rectangular insertion holes 72 in which attachment end portions 68*b* of the upstream separate peripheral guide plate 68 are fixedly fitted. In contrast, the peripheral-surface guide portions 67*a* of the downstream separate end guide plates 67 have rectangular fitting hole 73 in which end portions 64*c* and 64*d* of the body portion 64*a* of the first support plate 64 are fixedly fitted, and fitting holes 74 of substantially cylindrical cross section in which attachment end portions 69*b* of arc-shaped cross section of the downstream separate peripheral guide plate 69 are fixedly fitted.

In each pair of separate end guide plates 66 and 67, an end portion along the fitting hole 71 and an end portion along the fitting hole 73 are formed as linear end faces. The separate end guide plates 66 and 67 can be relatively displaced in the longitudinal direction of the fitting holes 73 and 74 while the end faces oppose each other.

As illustrated in FIG. 8, the upstream separate peripheral guide plate 68 has a curved body portion 68*a* extending long in the axial direction A and having a semicylindrical cross section. At either end of the curved body portion 68*a*, attachment end portions 68*b* each shaped like a flat plate project in the axial direction A. Further, plural ribs 68*c* are arranged on an outer peripheral surface of the curved body portion 68*a* at intervals in the axial direction A. The ribs 68*c* are linearly raised in the rotating direction of the fixing belt 42. The separate peripheral guide plate 68 also has a portion where a felt 49 impregnated with lubricant oil is provided to apply the lubricant oil onto the inner peripheral surface of the fixing belt 42 (see FIGS. 4 and 11).

The downstream separate peripheral guide plate 69 has a curved body portion 69*a* extending long in the axial direction A and having a semicylindrical cross section. At either end of the curved body portion 69*a*, arc-shaped attachment end portions 69*b* project in the axial direction A. Further, plural ribs 69*c* are arranged on an outer peripheral surface of the curved body portion 69*a* at intervals in the axial direction A. The ribs 69*c* are linearly raised in the rotating direction of the fixing belt 42.

For example, the pressing unit 43 (rigid member 61 and elastic member 62) is assembled as follows:

The rigid member 61 is assembled by passing the end portions 64*c* and 64*d* of the body portion 64 of the first support plate 64, which extends between the two downstream separate end guide plates 67A and 67B, through the fitting holes 73 of the separate end guide plates 67A and 67B and then inserting the body portion 64*a* of the first support plate 64 into the fitting portion 61*b*. The elastic member 62 is assembled by passing the end portions 65*c* and 65*d* of the body portion 65*a* of the second support plate 65, which extends between the two upstream separate end guide plates 66A and 66B, through the fitting holes 71 of the separate end guide plates 66A and 66B and then inserting the body portion 65*a* of the second support plate 65 into the fitting portion 60*b*.

The downstream separate peripheral guide plate 69 is combined with and fixed to the rigid member 61 by fitting the attachment end portions 69*b* into the fitting holes 74 of the downstream separate end guide plates 67A and 67B. The upstream separate peripheral guide plate 68 is combined with and fixed to the elastic member 62 by fitting the attachment end portions 68*b* into the fitting holes 72 of the upstream separate end guide plates 66A and 66B.

Figure 5:
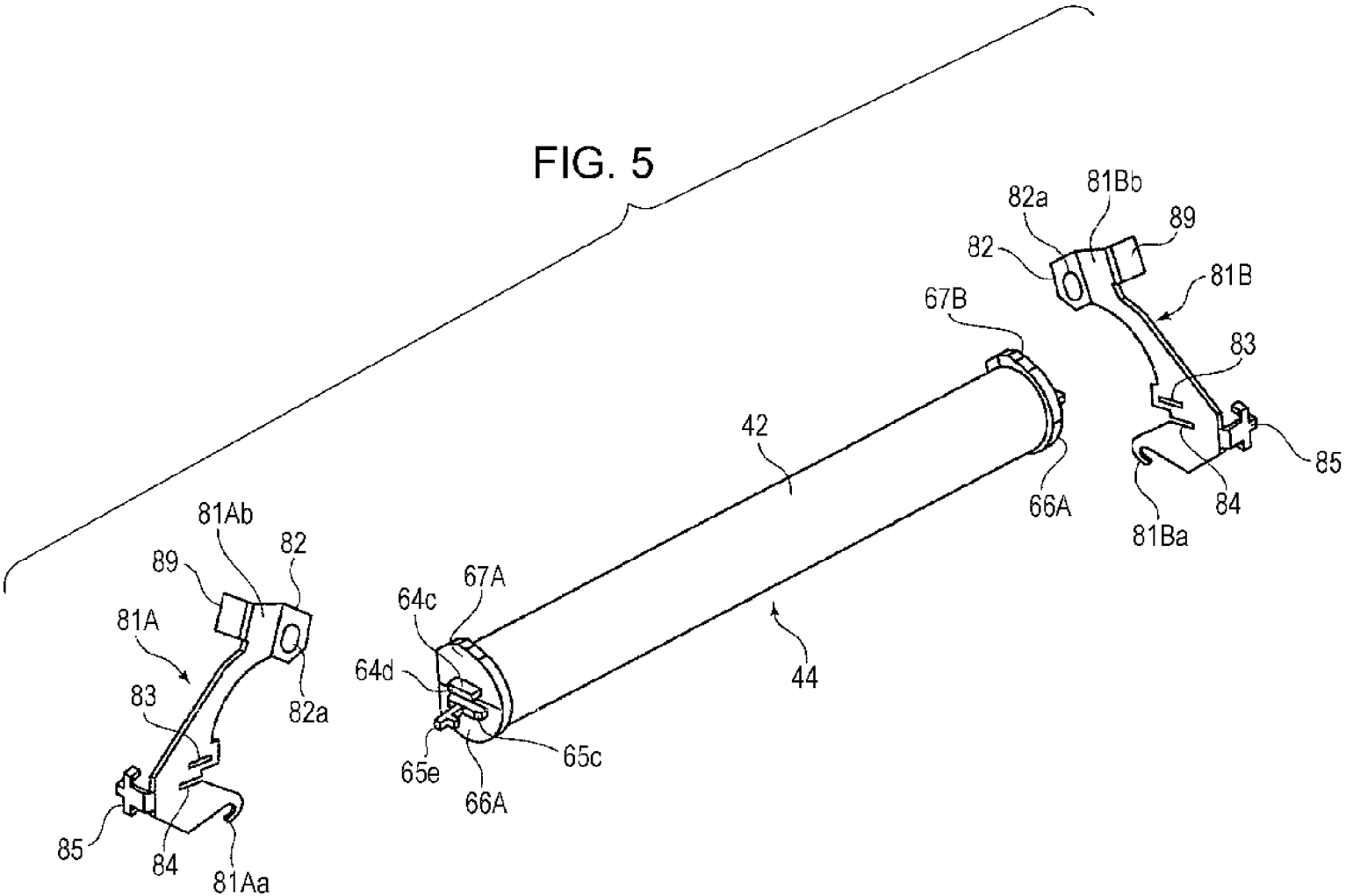
FIG. 5 is a perspective view of a pressing rotating member and pressing rocking frames in the fixing device illustrated in FIG. 2.

The rigid member 61 and the elastic member 62 of the pressing unit 43 are assembled and the separate peripheral guide plates 68 and 69 are attached thereto, thereby forming a structure having an outer appearance illustrated in FIGS. 6A and 6B. When the fixing belt 42 is attached to the outer peripheral portions of the guide plates 66 in the structure in FIGS. 6A and 6B, a structure having an outer appearance illustrated in FIG. 5 is formed (hereinafter this structure will also be referred to as a pressing rotating body 44). The fixing belt 42 illustrated in FIG. 5 can rotate while being held and guided in a substantially cylindrical form by the separate end guide plates 66 and 67 and the separate peripheral guide plates 68 and 69. The fixing belt 42 can also rotate while passing outside the rigid member 61 and the elastic member 62 of the pressing unit 43.

A pair of pressing rocking frames 81A and 81B are bent once away from the heating roller 41 between the end portions 51*a* of the fixed frames 51 upstream of the pressing portion NP in the passage direction B of the fixing object and the end portions 51*b* of the fixed frames 51 downstream of the pressing portion NP in the passage direction B.

End portions 81Aa and 81Ba of the pressing rocking frames 81A and 81B upstream of the pressing portion NP in the passage direction B of the fixing object are hook-shaped. The pressing rocking frames 81A and 81B are attached so as to rock in the directions of arrows C and D closer to and away from the heating roller 41 while the end portions 81Aa and 81Ba are caught by the first shafts 56 of the fixed frames 51A and 51B (FIG. 4).

Pressure for rocking the pressing rocking frames 81A and 81B in the direction of arrow C closer to the heating roller 41 is applied from the first pressure spring 87 to the pressing rocking frames 81A and 81B. End portions 81Ab and 81Bb of the pressing rocking frames 81A and 81B downstream of the pressing portion NP in the passage direction B of the fixing object are provided with spring pressing face portions 82 with which the first pressure springs 87 contact at one end to apply the spring force. The spring pressing face portions 82 are bent inward, and oppose the spring support face portions 52 of the fixed frames 51. The first pressure springs 87 are formed by coil springs having a required free length, spring constant, etc.

As illustrated in FIG. 4, each of the first pressure springs 87 is attached by a column 88 that is inserted in the space in a coil portion from one end and that has a length such as to protrude from the other end (length larger than the free length of the pressure springs). The column 88 includes a column body portion 88*a*, a flange portion 88*b* provided at the top of the column body portion 88*a* and having a diameter larger than the outer diameter of the coil portion of the coil spring, and a screw portion 88*c* provided at the bottom of the column body portion 88*a* and having a diameter smaller than the diameter of the column body portions 88*a*. Each spring pressing face portion 82 has a column passing hole 82*a* (hole having a diameter smaller than the outer diameter of the coil spring), as illustrated in FIG. 5.

The first pressure springs 87 are held between the flange portions 88*b* of the columns 88 fixed to the spring support face portions 52 of the fixed frames 51 by screws or nuts and the spring pressing face portions 82 of the pressing rocking frames 81, and are compressed by a predetermined compression amount. The first pressure springs 87 press the spring pressing face portions 82 of the pressing rocking frames 81A and 81B toward the spring support face portion 52 of the fixed frames 51 by a spring force F1 acting in accordance with the compression amount and spring constant, whereby the pressing rocking frames 81A and 81B are entirely rocked closer to the heating roller 41 (rocked in the direction of arrow C). Therefore, a pressure (pressing force) produced by thus rocking the pressing rocking frames 81A and 81B in the direction of arrow C is finally transmitted to the pressing unit 43.

As illustrated in FIG. 5, the bent portions of the pressing rocking frames 81A and 81B to which the pressing unit 43 is attached include rectangular attachment holes 83 in which the end portions 64*c* and 64*d* of the body portion 64*a* of the first support plate 64 are inserted and fixedly supported, and linear attachment cuts 84 in which the end portions 65*c* and 65*d* of the body portion 65*a* of the second support plate 65 are inserted so that the second support plate 65 is movable in the directions of arrows E and H closer to and away from the heating roller 41.

The end portions 64*c* and 64*d* of the first support plate 64 and the end portions 65*c* and 65*d* of the second support plate 65 that protrude from the separate end guide plates 66 and 67 of the pressing rotating body 44 illustrated in FIG. 5 are fitted in the attachment holes 83 and the attachment cuts 84 of the pressing rocking frames 81A and 81B, respectively.

Figure 10:
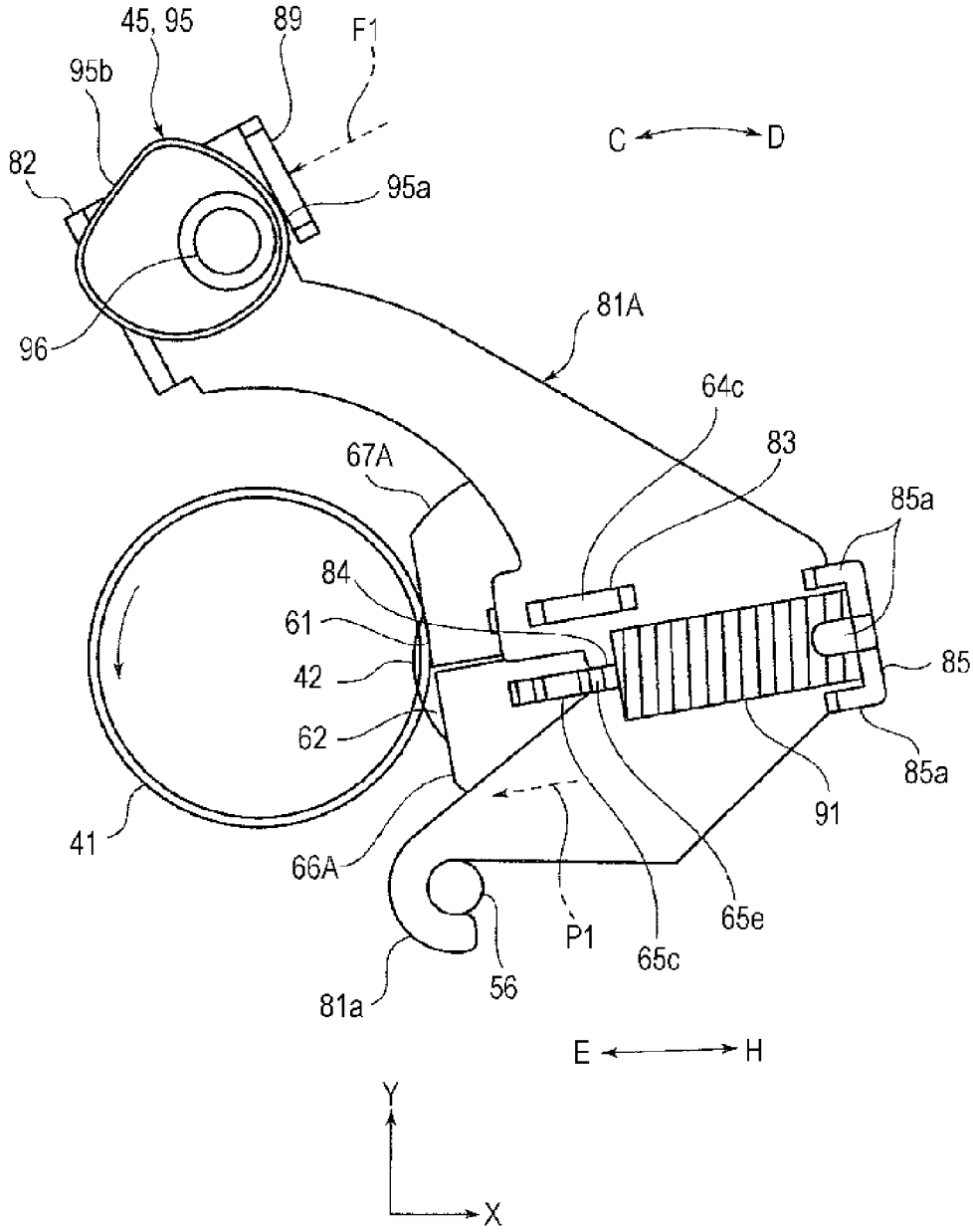
FIG. 10 illustrates the principal part of the fixing device in FIG. 4.

Thus, the first support plate 64 is fixed to the pressing rocking frames 81A and 81B via the attachment holes 83. The rigid member 61 fixed to the first support plate 64 is also fixed to the pressing rocking frames 81A and 81B. In contrast, the second support plate 65 is attached to the pressing rocking frames 81A and 81B via the attachment cuts 84 in a manner such as to be movable in the directions of arrows E and H closer to and away from the heating roller 41. Further, the elastic member 62 fixed to the second support plate 65 is also attached to the pressing rocking frames 81A and 81B in a manner such as to be movable in the directions of arrows E and H closer to and away from the heating roller (FIG. 10).

The second pressure springs 91 apply a pressure P1 such as to move the elastic member 62 serving as one component of the pressing unit 43 in the direction of arrow E toward the heating roller 41. The second pressure springs 91 are formed by coil springs having a predetermined free length, spring constant, etc. As illustrated in FIGS. 2, 3, and 10, the second pressure springs 91 are supported at one end by the spring support face portions 85 provided in the bent portions of the pressing rocking frames 81A and 81B, and are pressed at the other end against spring pressing portions 65*e* provided in the end portions 65*b* and 65*c* of the second support plate 65 that protrude from the separate end guide plates 66 and 67. The second pressure springs 91 are attached while being compressed to a predetermined length as a whole.

Thus, the second pressure springs 91 apply, to the spring pressing portions 65*e* of the second support plate 65, the pressure P1 that moves the elastic member 62 in the direction of arrow E toward the heating roller 41, and further apply the pressure P1 to the elastic member 62 via the second support plate 65. The elastic member 62 to which the pressure P1 is applied is allowed to move in the direction of arrow E toward the heating roller 41 along the attachment cuts 84 of the pressing rocking frames 81, and is finally pressed against the heating roller 41 with the fixing belt 42 being disposed therebetween.

The spring support portions 85 of the pressing rocking frames 81 are face-shaped portions bent outward at the bent portions of the pressing rocking frames 81A and 81B, and are each provided with plural bent portions 85*a* for holding the end portions of the second pressure springs 91. The spring pressing portions 65*e* of the second support plate 65 form projections 65*f* to be inserted in the coil portions of the second pressure springs 91. The pressure P1 applied by the second pressure springs 91 may be any pressure that can reduce wrinkles in a special bag-shaped recording medium, such as an envelope, during fixing. In the first exemplary embodiment, the pressure P1 is set at a value smaller than the above-described pressure F1 applied by the first pressure springs 87 (e.g., a value about 30 to 40% smaller). Further, since the first exemplary embodiment adopts this setting of the relationship in volume of the pressure and the above-described configuration, a pressure Pb at the pressing portion NP in the second state finally becomes smaller than a pressure Pa of the pressing portion NP in the first state (Pb<Pa). For this reason, by adopting a structure such that the pressures at the pressing portion NP have the relationship Pb<Pa (for example, by combining a structure using the principle of leverage), the relationship in volume between the pressure F1 applied by the first pressure springs 87 and the pressure P1 applied by the second pressure springs 91 may be different from the above relationship (P1<F1), for example, may be (P1≥F1).

Figure 14:
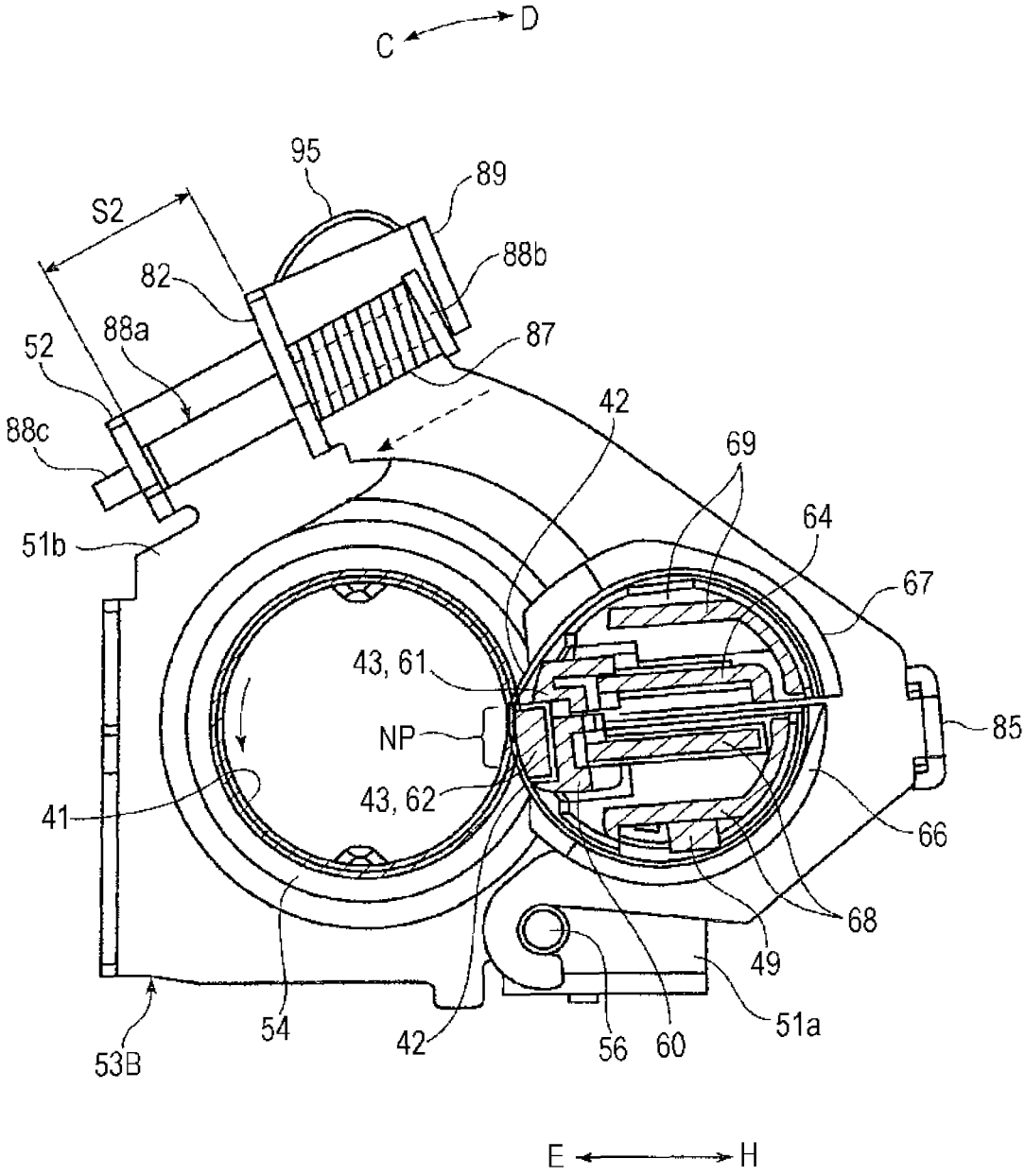
FIG. 14 is a partial cross-sectional view of the fixing device, taken along line XIV-XIV in FIG. 12 (in an envelope mode)
Figure 16:
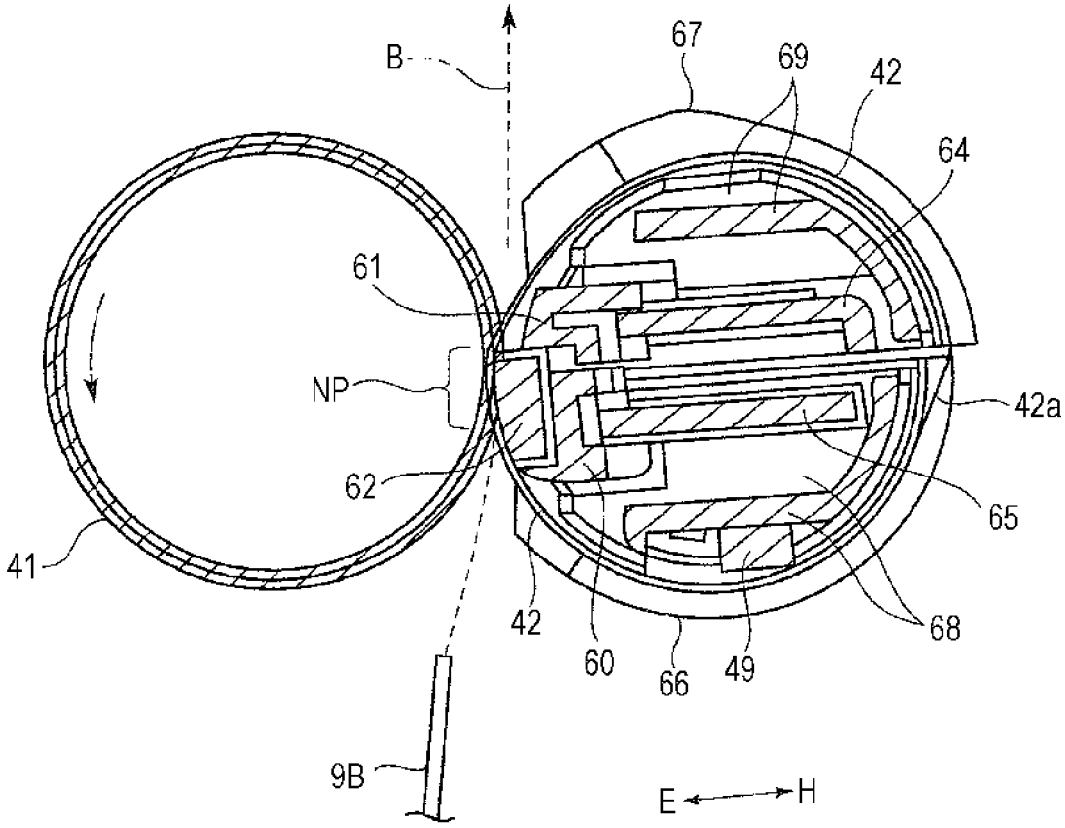
FIG. 16 is a partial cross-sectional view of the principal part of the fixing device in FIGS. 15A and 15B.

The switch mechanisms 45 change the rocking range of the pressing rocking frames 81A and 81B so as to switch between a first state in which the rigid member 61 and the elastic member 62 of the pressing unit 43 are pressed against the heating roller 41 with the fixing belt 42 being disposed therebetween (FIGS. 4 and 11) and a second state in which only the elastic member 62 is pressed against the heating roller 41 with the fixing belt 42 being disposed therebetween (FIGS. 14 and 16). Here, the first state corresponds to the above-described normal mode, and the second state corresponds to the above-described envelope mode.

As illustrated in FIGS. 2, 3, and 10, the switch mechanisms 45 of the first exemplary embodiment are formed by disc cams 95 that can contact cam receiving face portions 89 provided at free ends (end portions 81*b* opposite the end portions 81*a* supported by the shafts 56) of the pressing rocking frames 81A and 81B. The disc cams 95 are fixed to a rotation shaft 96 rotatably provided in the housing 40 of the fixing device or parts of the fixed frames 51.

Figure 13:
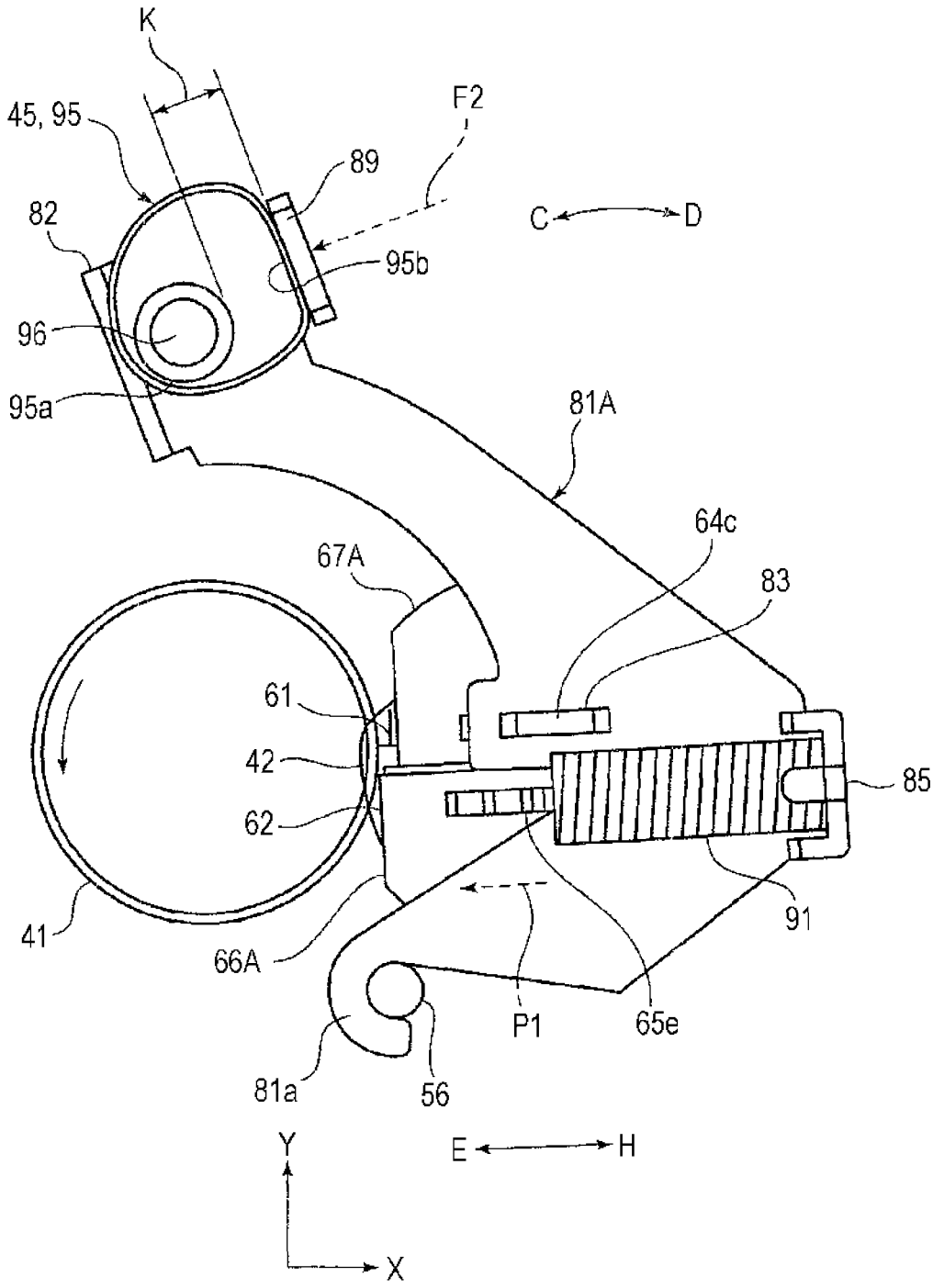
FIG. 13 illustrates the principal part of the fixing device illustrated in FIG. 12.

Further, as illustrated in FIGS. 10 and 13, the disc cams 95 have first cam faces 95*a* that do not contact the cam receiving face portions 89 in the first state and second cam faces 95*b* that contact the cam receiving face portions 89 in the second state so as to rock the pressing rocking frames 81 in the direction D away from the heating roller 41 and to stop and hold the rigid member 61 fixed to the pressing rocking frames 81 at a position separate from the heating roller 41. The second cam faces 95*b* are at a greater distance from the rotation shaft 96 than the first cam faces 95*a*.

The rotation shaft 96 of the disc cams 95 can be manually rotated by the user of the image forming apparatus or automatically rotated by the driving force of a rotation device. When the rotation shaft 96 is manually rotated by the user, for example, an operation lever capable of rotating the rotation shaft 96 in a predetermined direction is attached to the rotation shaft 96 directly or indirectly. When the first cam faces 95*a* of the disc cams 95 are at positions opposing the cam receiving face portions 89 of the pressing rocking frames 81, the rotation shaft 96 is located at a position such that the first cam faces 95*a* are out of contact with the cam receiving face portions 89. In this case, the pressing rocking frames 81 bring the rigid member 61 of the pressing unit 43 into contact with the heating roller 41 with the fixing belt 42 being disposed therebetween, and the pressing rocking frames 81 are pressed in the direction of arrow C toward the heating roller 41 by receiving the pressure F1 from the first pressure springs 87.

Next, the operation of the fixing device 4 will be described.

First, a description will be given of an operation performed when image formation is performed using a sheet 9A different from an envelope-like medium as a recording medium 9 (normal mode).

Figure 11:
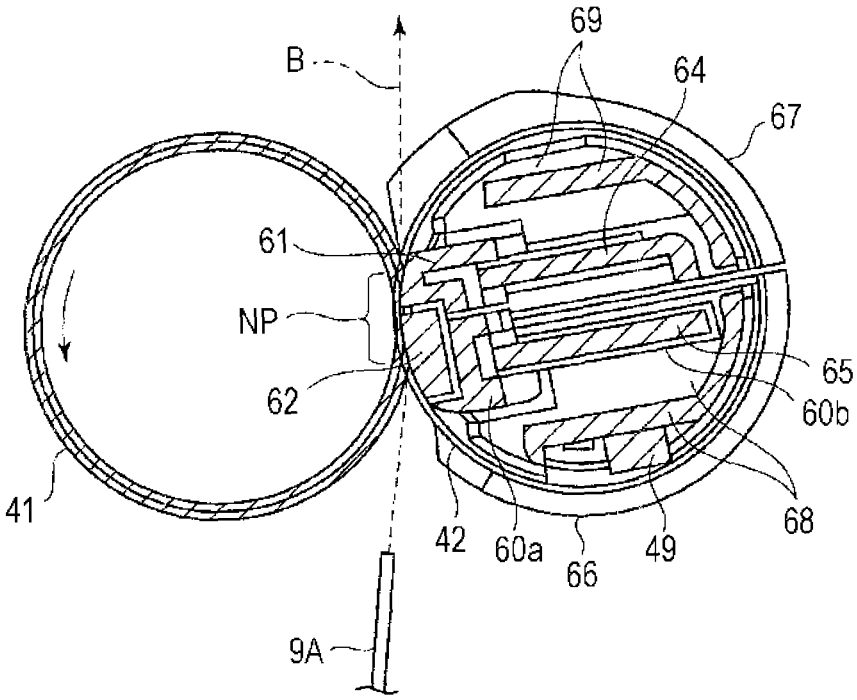
FIG. 11 is a partial cross-sectional view of the principal part of the fixing device in FIG. 10.

When a normal mode is selected, as illustrated in FIGS. 4, 10, and 11, the disc cams 95 of the switch mechanisms 45 in the fixing device 4 are held in a state in which the first cam faces 95*a* oppose the cam receiving face portions 89 of the pressing rocking frames 81A and 81B (strictly, in the above-described non-contact state).

Thus, the cam receiving face portions 89 of the pressing rocking frames 81A and 81B are out of contact with the disc cams 95. For this reason, the rocking range of the pressing rocking frames 81A and 81B is not particularly restricted by the disc cams 95, and therefore, the pressing rocking frames 81A and 81B are kept in a state such as to be able to rock on the shafts 56 in the direction of arrow C toward the heating roller 41 while receiving the spring force F1 from the first pressure springs 87.

As a result, the pressing rocking frames 81 rock in the direction of arrow C toward the heating roller 41, and the rigid member 61 of the pressing unit 43 is placed closer to the heating roller 41 via the first support plate 64 fixed to the pressing rocking frames 81, as illustrated in FIGS. 4, 10, and 11. Finally, the rigid member 61 is kept in contact with the heating roller 41 with the fixing belt 42 being disposed therebetween. In this case, the second support plate 65 remains pressed in the direction of arrow E toward the heating roller 41 along the attachment cuts 84 of the pressing rocking frames 81 by receiving the pressure P1 from the second pressure springs 91. Hence, the elastic member 62 attached to the second support plate 65 is finally kept in contact with the heating roller 41 with the fixing belt 42 being disposed therebetween.

Therefore, in this case, the pressing unit 43 is kept in a state in which both the rigid member 61 and the elastic member 62 press the fixing belt 42 against the surface of the heating roller 41 (see FIGS. 4 and 11). That is, this state corresponds to the above-described first state (normal mode).

In this first state, the separation end guide plates 66 and 67 that hold and guide the fixing belt 42 are in a state in which the pressing-portion opposing portions 66*c* and 67*c* are aligned (coincide) to form one straight line or surface (FIG. 9). The separate peripheral guide plates 68 and 69 are also in a state in which the peripheral-surface guide portions 68*a* and 69*a* are aligned (coincide) to form a common cylindrical surface (FIGS. 4 and 6). Thus, the fixing belt 42 is allowed to rotate while being entirely kept in a substantially cylindrical form by the separate end guide plates 66 and 67 and the separate peripheral guide plates 68 and 69 (FIGS. 4 and 5).

In this case, the spring pressing face portions 82 of the pressing rocking frames 81 are kept at a predetermined distance (S1) from the spring support face portions 52 of the fixed frames 51. The distance from the spring pressing face portions 82 of the pressing rocking frames 81 to the flange portions 88*b* of the columns 88 serves as a distance for the normal mode. This distance for the normal mode is set to be shorter than a free length L1 of the first pressure springs 87. Therefore, the first pressure springs 87 are kept in a compressed state. As a result, the first pressure springs 87 provide the pressure F1 (spring force=compression amount×spring constant) in accordance with the compression amount and the spring constant, thereby continuously pressing the spring pressing face portions 82 of the pressing rocking frames 81 toward the spring support face portions 52 of the fixed frames 51. In this case, the principle of leverage using the shafts 56 as the pivots, the spring pressing face portions 82 as the points of effort, and the insertion holes 83 as the points of load acts on the pressing rocking frames 81. Hence, a strong force obtained by increasing the spring force F1 by the principle of leverage is transmitted from the pressing rocking frames 81 to the first support plate 54 of the attachment holes 83 serving as the points of load.

With this, the rigid member 61 is pressed against the heating roller 41 by the pressing rocking frames 81 and the first pressure springs 87 while receiving, via the first support plate 64, the pressure increased by the principle of leverage.

In contrast, the elastic member 62 is pressed against the heating roller 41 while receiving, via the second support plate 65, the pressure (spring force) P1 provided by the second pressure springs 91 compressed in the pressing rocking frames 81. This pressure P1 is lower than the pressure F1 applied from the first pressure springs 87, as described above.

From the above, in the normal mode, the high pressure F1 is applied to the pressing portion NP in the fixing device 4 via the rigid member 61, and the pressure P1 lower than the pressure F1 is also applied to the pressing portion NP via the elastic member 62. Moreover, the pressing portion NP is formed by the presses of the rigid member 61 and the elastic member 62 in the pressing unit 43. Further, the pressure (distribution) applied to the pressing portion NP of the heating roller 41 when the normal mode is selected is higher at the rigid member 61 provided downstream in the passage direction B of the fixing object than the elastic member 62 provided upstream in the passage direction B of the fixing object.

As illustrated in FIG. 11, in the normal mode, when the sheet-like recording medium 9A serving as a fixing object having an unfixed toner image enters the pressing portion NP in the fixing device 4, the elastic member 62 provided on the upstream side in the passage direction B of the fixing object in the pressing portion NP first presses the recording medium 9A against the rotating heating roller 41 (with the fixing belt 42 being disposed therebetween). Subsequently, the rigid member 61 provided on the downstream side in the passage direction B of the fixing object presses the recording medium 9A against the heating roller 41 (with the fixing belt 42 being disposed therebetween). In the normal mode, the fixing operation is thus performed so that the sheet-like recording medium 9A passes through the pressing portion NP having a nonuniform pressure distribution in the passage direction B.

Next, a description will be given of a case in which image formation is performed using an envelope-like medium 9B, such as an envelope, as a recording medium 9 (envelope mode).

Figures 12A, 12B:
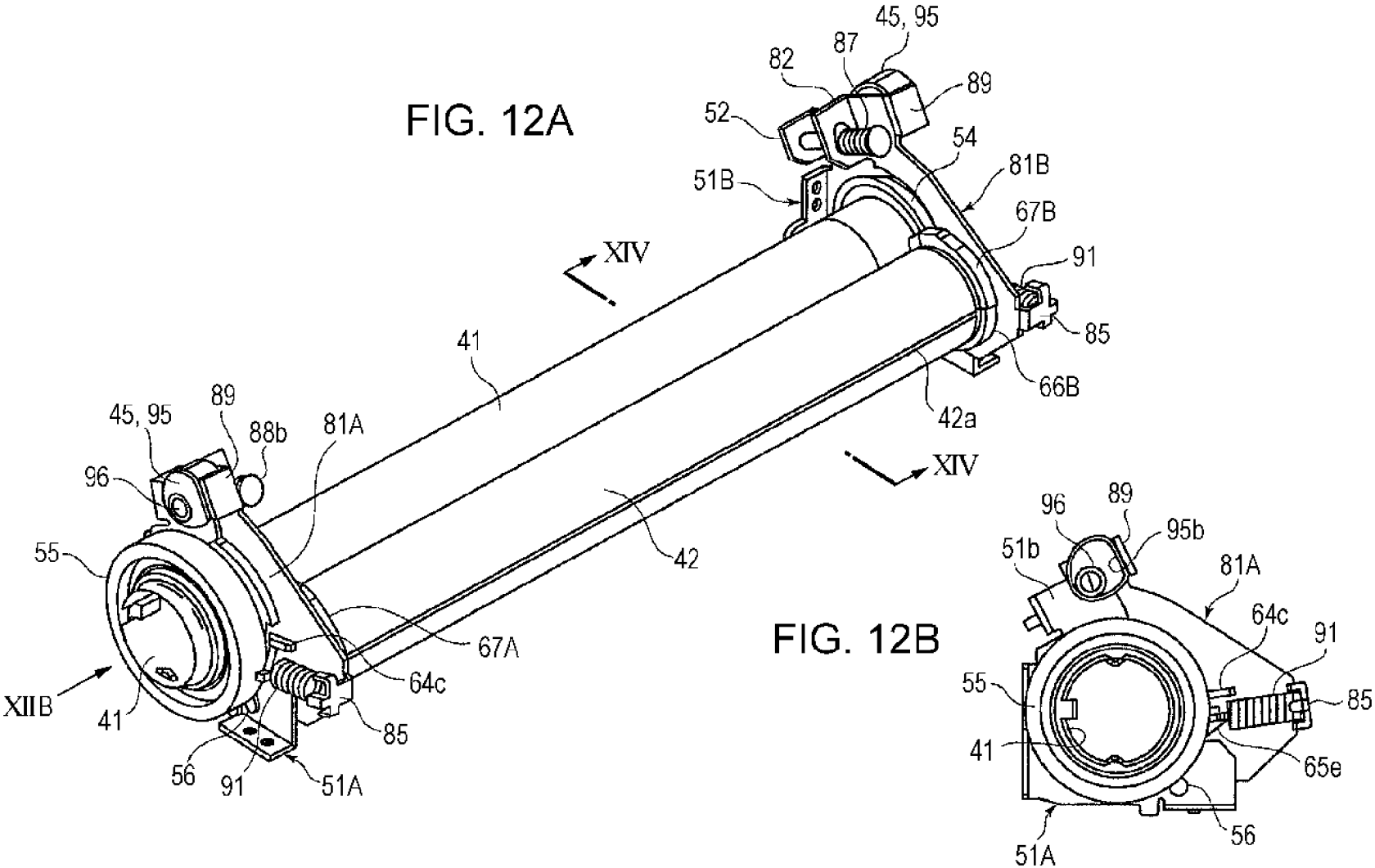
FIG. 12A is a perspective view of the fixing device in an envelope mode.
FIG. 12B is a side view of the fixing device on arrow XIIB in FIG. 12A.

When an envelope mode is selected, in the fixing device 4, the disc cams 95 of the switch mechanisms 45 are held in a state in which the second cam faces 95*b* oppose the cam receiving face portions 89 of the pressing rocking frames 81A and 81B, as illustrated in FIGS. 12 and 13.

Thus, the pressing rocking frames 81A and 81B are stopped after the cam receiving face portions 89 are pressed and displaced by a predetermined amount by the second cam faces 95*b* of the disc cams 95. That is, the pressing rocking frames 81A and 81B are rocked on the shafts 56 in the direction D away from the heating roller 41, and are stopped at a position where the rigid member 61 of the pressing unit 43 fixed to the pressing rocking frames 81 is separate from the heating roller 41. In the first exemplary embodiment, the cam receiving face portions 89 of the pressing rocking frames 81 are displaced and held at a distance K (FIG. 13) from the rotation shaft 96 by the second cam faces 95*b* of the disc cams 95.

As a result, when the pressing rocking frames 81 rock in the direction D away from the heating roller 41, the rigid member 61 is moved away from the heating roller 41 via the first support plate 64 fixed to the pressing rocking frames 81, as illustrated in FIGS. 14 and 16. Therefore, the rigid member 61 is finally kept separate from the heating roller 41. In this case, the second support plate 65 receives the pressure P1 from the second pressure springs 91, and is brought into a state such as to be able to be pressed and moved in the direction E toward the heating roller 41 along the attachment cuts 84 in the pressing rocking frames 81. Therefore, the elastic member 62 attached to the second support plate 65 moves in the direction E toward the heating roller 41 from the position in the normal mode, and is finally kept in contact with the heating roller 41 with the fixing belt 42 being disposed therebetween. The elastic member 62 moves relative to the rigid member 61 in the opposite direction on the pressing rocking frames 81.

Therefore, the pressing unit 43 is kept in a state in which only the elastic member 62 presses the fixing belt 42 against the surface of the heating roller 41 (see FIGS. 14 and 16). That is, this state corresponds to the above-described second state (envelope mode). Switching to the second state is made by one operation of the disc cams 95 of the switching mechanisms 45.

Figure 15A:
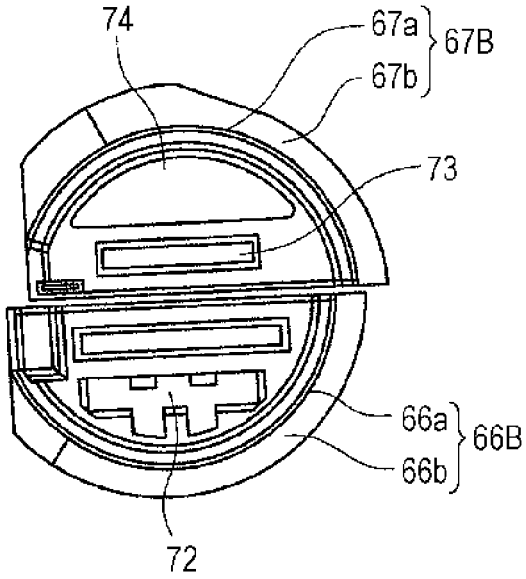
FIGS. 15A and 15B illustrate the separate end guide plates of the fixing device in FIG. 14, as viewed from the front and back sides.
Figure 15B:
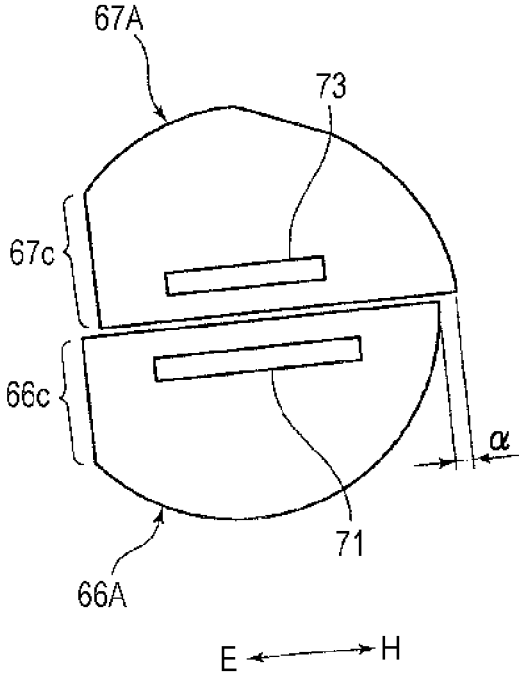

Since the second support member 65 moves in the direction E toward the heating roller 41 in the second state, as described above, the upstream separate end guide plates 66 attached integrally with the second support plate 65, of the separate end guide plates 66 and 67 that hold and guide the heating roller 41, move together with the second support plate 65 in the direction E toward the heating roller 41, and come out of alignment with the downstream separate end guide plates 67 (FIGS. 15A and 15B). In FIG. 15B, $\alpha$ represents the relative displacement amount of the upstream separate end guide plates 66 from the downstream separate end guide plates 67.

The upstream separate peripheral guide plate 68 attached integrally with the second support plate 65 also moves in the direction E toward the heating roller 41 by the same amount as that for the upstream end guide plates 66, and comes out of alignment with the downstream separate peripheral guide plate 69 (FIGS. 14 and 16).

This brings the fixing belt 42 into a state in which the fixing belt 42 can be rotated in a substantially elliptic shape as a whole by the separate end guide plates 66 and 67 and the separate peripheral guide plates 68 and 69 that are out of alignment (FIGS. 14 and 16). In FIGS. 12 and 16, reference numeral 42*a* denotes an inflected portion (deformed portion) formed in the fixing belt 42 by the misalignment of the upstream guide plates 66 and 68.

In this case, the spring pressing face portions 82 of the pressing rocking frames 81 are kept in a state in which a distance S2 thereof from the spring support face portions 52 of the fixed frames 51 is longer than the distance S1 in the normal mode (S2>S1). This keeps the first pressure springs 87 more compressed than in the normal mode. However, the rigid member 61 fixed to the pressing rocking frames 81 via the first support plate 64 is separate from the heating roller 41, and the rocking movement of the pressing rocking frames 81 in the direction C toward the heating roller 41 is restricted (stopped) by the disc cams 95. For this reason, the spring force F2 (>F1) of the compressed first pressure springs 87 is not transmitted to the rigid member 61 via the first support plate 64.

In contrast, in a manner similar to that adopted in the normal mode, the elastic member 62 is pressed against the heating roller 41 while receiving the pressure (spring force) P1 from the compressed second pressure springs 91 in the pressing rocking frames 81 via the second support plate 65.

From the above, in the envelope mode, only the pressure P1 lower than the pressure F1 is applied to the pressing portion NP of the fixing device 4 via the elastic member 62. Moreover, the pressing portion NP is formed by only the press of the elastic member 62 of the pressing unit 43. For this reason, in the envelope mode, the pressure Pb at the pressing portion NP in the second state becomes lower than the pressure Pa at the pressing portion NP in the first state of the normal mode (Pb<Pa).

In this case, the pressure P1 is also lower than the pressure F1 applied from the first pressure springs 87, as described above. Hence, the separate end guide plates 66 and the separate peripheral guide plate 68 on the upstream side relatively move and are displaced, and the fixing belt 42 is kept in a substantially elliptic shape as a whole. To the fixing belt 42 of this shape, the relatively low pressure P1 is applied from the second pressure springs 91. For this reason, an excessive pressure is not applied to the fixing belt 42 entirely deformed in a substantially elliptic shape, and therefore, it is possible to prevent a situation in which the total tension of the fixing belt 42 increases and the frictional resistance (torque) to the elastic member 62, and the guide plates 66 to 69 increases. As a result, it is possible to avoid a possibility that the transport of the envelope-like recording medium 9B passing through the pressing portion NP will be delayed because of the increase in total tension of the fixing belt 42 and increase in frictional resistance to the elastic member 62 and so on, and that this will cause trouble such as disturbance of an image to be fixed and decrease in durability of the fixing belt 42.

In the envelope mode, when the envelope-like recording medium 9B serving as the fixing object having an unfixed toner image enters the pressing portion NP in the fixing device 4, as illustrated in FIG. 16, only the elastic member 62 to which the low pressure P1 is applied presses the recording medium 9B against the heating roller 41 (with the fixing belt 42 being disposed therebetween). In this way, in the envelope mode, the fixing operation is conducted on the envelope-like recording medium 9B in a (dynamically) well-balanced environment in which the applied pressure is lower than in the normal mode, the pressing portion NP formed by the elastic member 62 is elastically deformed in accordance with the passage state of the recording medium 9B, and the second pressure springs 91 are also compressed by the required amount in accordance with the passage state.

Also, in the envelope mode, the pressure of the first pressure springs 87 is not applied via the rigid member 61, and the pressure at the pressing portion NP becomes lower than in the normal mode (first state), as described above. Hence, the recording medium 9B passing through the pressing portion NP is not compressed more than in the normal mode. As a result, in the envelope mode, the envelope-like recording medium 9B (particularly an end area on the upstream side in the passage direction B) is not wrinkled, and this makes proper fixing possible.

Further, in the envelope mode, with the relative movement of the elastic member 62 of the pressing unit 43, the separate end guide plates 66 and the separate peripheral guide plate 68 on the upstream side move similarly. Hence, the fixing belt 42 is stably held and guided to an entrance side of the pressing portion NP by the guide plates 66 and 68. With this, the recording medium 9B is also stable led to the entrance side of the pressing portion NP, in a manner substantially similar to that adopted for the recording medium 9A in the normal mode. This prevents wrinkling of the recording medium 9B and disturbance of the image on the fixing object.

Further, in the envelope mode, when the rigid member 61 of the pressing unit 43 is displaced with rocking of the pressing rocking frames 81, the separate end guide plates 67 and the separate peripheral guide plate 69 on the downstream side are displaced similarly. Hence, a portion of the fixing belt 42 coming out of the exit side of the pressing portion NP is stably held and guided by the downstream guide plates 67 and 69. With this, the recording medium 9B is also stably output from the exit side of the pressing portion NP, in a manner substantially similar to that for the recording medium 9A in the normal mode, and the running ability of the recording medium 9B is prevented from being reduced during the output.

Other Exemplary Embodiments

While the disc cams 95 are used as the switch mechanisms 45 in the first exemplary embodiment, other structures may be adopted as long as they allow an operation in which the pressing rocking frames 81 rock away from the heating roller 41 and in which one of the structures that form the pressing unit 43 fixed to the pressing rocking frames 81 is stopped and held at a position separate from the heating roller 41.

As the first pressure springs 87 and the second pressure springs 91, for example, plate-shaped springs can be used instead of the coil springs.

Further, in the fixing device 4, a fixing roller having no heating element can be used instead of the heating roller 41, and a pressing and heating member having a heating element can be used as the pressing unit 43. For example, when the heating element of the pressing and heating member is an electromagnetic induction heating element, an endless belt having a conductive layer can be used as the fixing belt 42.

As the imaging device 2 in the image forming apparatus 1, an imaging device that forms a multicolor image by forming toner images of plural colors and transferring the toner images onto the recording medium 9 can be adopted. As the transfer method adopted in the imaging device 2, for example, a known intermediate transfer method can be used instead of the direct transfer method.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a rotatable fixing roller;

an endless fixing belt that rotates in contact with the fixing roller;

a pressing unit having a first pressing member and a second pressing member, the first pressing member contacting the fixing belt from a back side of the fixing belt and pressing a surface of the fixing belt against the fixing roller to form a fixing portion through which a fixing object passes, the second pressing member contacting the fixing belt from the back side of the fixing belt and pressing the surface of the fixing belt against the fixing roller to form the fixing portion through which the fixing object passes;

a fixed support member that supports the fixing roller rotatably;

a movable support member that rocks closer to and away from the fixing roller, supports the first pressing member in a fixed state, and supports the second pressing member adjacent to the first pressing member in a manner such that the second pressing member is movable closer to and away from the fixing roller;

a first pressure spring that applies pressure to move the movable support member closer to the fixing roller;

a second pressure spring that applies pressure to move the second pressing member closer to the fixing roller; and a switch mechanism that changes a movable range of the movable support member so as to switch between a first state in which the first pressing member and the second pressing member are pressed against the fixing roller with the fixing belt being disposed therebetween and a second state in which only the second pressing member is pressed against the fixing roller with the fixing belt being disposed therebetween, wherein the first pressing member is an inelastic material, and the second pressing member is an elastic material.

2. The fixing device according to claim 1, wherein the switch mechanism selects the second state by rocking the movable support member away from the fixing roller and stopping and holding the movable support member at a position where the first pressing member is separate from the fixing roller.

3. The fixing device according to claim 2, wherein the switch mechanism includes a cam that rocks the movable support member in contact with a part of the movable support member and holds the movable support member at a required position.

4. The fixing device according to claim 1, wherein a pressure at the fixing portion in the second state is set to be lower than in the first state.

5. The fixing device according to claim 1, further comprising:

a first belt holding member that rotatably holds a portion of the fixing belt located on a side of the second pressing member from the back side, the first belt holding member being attached movably together with the second pressing member.

6. The fixing device according to claim 1, further comprising:

a second belt holding member that rotatably holds a portion of the fixing belt on a side of the first pressing member from the back side, the second belt holding member being fixed to the first pressing member.

7. An image forming apparatus comprising:

an image forming unit that forms and transfers an unfixed image onto a recording medium; and the fixing device according to claim 1, the fixing device fixing the unfixed image transferred by the image forming unit onto the recording medium.

8. The fixing device according to claim 1, wherein the second pressure spring is disposed outside of the fixing belt.

9. The fixing device according to claim 1, wherein the second pressure spring is attached to a portion of the movable support member.

* * * * *